US007702449B2

(12) United States Patent
Rodriguez et al.

(10) Patent No.: US 7,702,449 B2
(45) Date of Patent: Apr. 20, 2010

(54) HIGH PRESSURE OIL LIMIT BASED ON FUEL LEVEL TO PROTECT FUEL INJECTORS

(75) Inventors: Rogelio Rodriguez, Plainfield, IL (US); Michael Beyene, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 104 days.

(21) Appl. No.: 12/184,841

(22) Filed: Aug. 1, 2008

(65) Prior Publication Data

US 2010/0030452 A1 Feb. 4, 2010

(51) Int. Cl.
*F02M 37/04* (2006.01)
*F02M 7/00* (2006.01)

(52) U.S. Cl. ..... 701/104; 123/511

(58) Field of Classification Search ..... 701/104, 701/103, 105, 102; 123/446, 447, 502, 511
See application file for complete search history.

(56) References Cited

U.S. PATENT DOCUMENTS

| | | | | |
|---|---|---|---|---|
| 5,460,329 | A | 10/1995 | Sturman | |
| 5,479,778 | A * | 1/1996 | Toyooka et al. | 60/431 |
| 5,560,825 | A * | 10/1996 | Shafer | 210/430 |
| 5,564,391 | A * | 10/1996 | Barnes et al. | 123/446 |
| 5,597,118 | A | 1/1997 | Carter et al. | |
| 5,722,373 | A | 3/1998 | Paul et al. | |
| 5,839,412 | A * | 11/1998 | Stockner et al. | 123/446 |
| 6,029,628 | A | 2/2000 | Oleksiewicz et al. | |
| 6,850,832 | B1 | 2/2005 | Rodriguez et al. | |

* cited by examiner

*Primary Examiner*—Hieu T Vo
(74) *Attorney, Agent, or Firm*—Jack D. Nimz; Jeffrey P. Calfa

(57) ABSTRACT

A first fuel value (FL_Signal) indicative of the quantity of fuel presently in a fuel tank (34) and a second fuel value (FL_LOW_THLD) representing a quantity of fuel in the tank at which a maximum Injection Control Pressure (ICP) limit should be changed are processed by a processor (22). When the result of the processing discloses that the second fuel value is less than the first fuel value, the maximum ICP limit is reduced from a greater value (ICPC_NORMAL_LMX) to a lesser value (ICPC_FL_LMX).

15 Claims, 1 Drawing Sheet

HIGH PRESSURE OIL LIMIT BASED ON FUEL LEVEL TO PROTECT FUEL INJECTORS

FIELD OF THE INVENTION

This invention relates to internal combustion engines having combustion chambers into which fuel is injected by electric-actuated fuel injectors that use hydraulic fluid (oil) under pressure to force injections of fuel when electric signals operate valves in the injectors to allow oil pressure to force fuel out of the injectors and into the combustion chambers. Such fuel injectors are sometimes referred to as HEUI fuel injectors (Hydraulic Electric Unit Injectors).

BACKGROUND OF THE INVENTION

A known electronic engine control system comprises a processor-based engine controller that processes data from various sources to develop control data for controlling certain functions of the engine, including fueling of the engine by injection of fuel into engine combustion chambers. Control of engine fueling involves several factors. One is the quantity of fuel injected during an injection. Another is the timing of an injection. Consequently, the control system must set both the quantity of fuel injected and the time at which the injection occurs during an engine operating cycle.

A known diesel engine that powers a motor vehicle has an oil pump that delivers oil under pressure to an oil rail serving electric-actuated fuel injectors that use oil from the oil rail to force injections of fuel. Fuel under pressure is supplied to the fuel injectors via a fuel rail.

The pressure in the oil rail is sometimes referred to as injection control pressure, or ICP, and that pressure is under the control of an appropriate ICP control strategy that is an element of the overall engine control strategy implemented in the engine control system. ICP is a factor in controlling the quantity of fuel injected during an injection.

Examples of fuel systems containing fuel injectors that utilize ICP oil to force fuel into engine combustion chambers via plungers are found in U.S. Pat. Nos. 5,460,329; 5,597,118; 5,722,373; and 6,029,628.

A representative HEUI fuel injector has a plunger that is displaced within an internal pumping chamber by oil at ICP from an oil rail when a normally closed control valve in the injector opens in response to a signal from the engine controller to inject fuel into a combustion chamber. The oil acts via the plunger to amplify the fuel pressure in the pumping chamber to a magnitude large enough to force a normally closed valve at an outlet of the fuel injector to open. When the latter valve opens, the amplified fuel pressure forces fuel through the outlet and into the combustion chamber.

The injection is terminated by terminating the signal that caused the control valve to open. When that happens, the valve at the fuel injector outlet returns to normally closed condition, and fuel flows from the fuel rail to refill the pumping chamber, forcing the plunger to retract in the process.

Because ICP in the oil rail is a significant factor in controlling the quantity of fuel injected during an injection, the ability to accurately control ICP is of obvious importance in an engine control strategy. Control of ICP is typically somewhat complicated because changing engine conditions can act in ways that tend to change ICP. Various strategies exist for controlling ICP, such as the one described in U.S. Pat. No. 6,850,832.

When a fuel-injected diesel engine is being operated at high speed and high load, the fuel injectors operate near or at the limit of their capability where the frequency of operation and the quantity of fuel injected per injection are near or at their maximums. Consequently, full recharging of a fuel injector after the termination of an injection requires that a maximum, or near maximum, quantity of fuel flow into the pumping chamber within a minimum, or near minimum, amount of time.

SUMMARY OF THE INVENTION

Briefly, the present invention relates to an improvement in control of ICP that is intended to protect a fuel injector against damage, or outright failure, due to high-speed, high-load operation in a particular situation where a potential for damage or failure may exist. The particular situation involves a low amount of fuel in a tank of a fuel supply system that supplies fuel to a high-pressure pump that pumps fuel to the fuel rail.

One typical fuel supply system comprises a fuel tank that holds a supply of liquid fuel and a transfer pump that pumps fuel to the high-pressure pump. When a motor vehicle, such as a heavy truck for example, is being driven, and the fuel supply in the fuel tank that is supplying the high-pressure fuel pump becomes low, fuel slosh may prevent the entrance of the draw tube, through which fuel in the tank is being supplied, from staying continuously submerged in liquid fuel. If the engine is operating at high-speed, high-load when that occurs, the high-pressure pump may be unable to keep a solid head of liquid fuel in the fuel rail at the pressure needed to enable the fuel injectors to be fully refilled after injections due to momentary starvation and/or cavitation of the pump. This condition may lead to erratic engine operation and/or fuel injector damage and/or even fuel injector failure.

One aspect of the present invention relates to a system and method for guarding against fuel injector damage or failure when fuel in a fuel supply tank is running low. General principles of the invention contemplate the use of a signal that is capable of identifying when the amount of fuel in the fuel tank supplying the high-pressure fuel pump falls to an amount that has been deemed to precurse potential pump starvation and/or cavitation. The signal is used as an input to the basic ICP control strategy to activate a sub-strategy for imposing a limit on maximum ICP that will override any higher maximum ICP that the ICP control strategy might otherwise command. While this is apt to create a change in engine operation whose effect on the vehicle may be noticed by the driver, the activation of the sub-strategy can be signaled to the driver in any suitably appropriate way so that corrective action, i.e. filling the fuel tank, can be taken.

Accordingly, a generic aspect of the invention relates to an internal combustion engine comprising: a fuel system that draws liquid fuel from a fuel tank to charge fuel injectors that when actuated by a control system force fuel charges into engine combustion chambers using hydraulic fluid at injection control pressure (ICP). The control system comprises a processor that executes an ICP control strategy to set ICP.

The strategy comprises processing a first value indicative of the quantity of fuel presently in the tank and a second value representing a quantity of fuel in the tank at which a maximum limit for ICP set by the ICP control strategy should be changed, and when the result of the processing discloses that the second value is less than the first value, the ICP control strategy reduces the maximum limit for ICP from a greater value to a lesser value.

Another generic aspect relates to the fueling system that has just been described.

Still another generic aspect relates to the method that is performed by the fueling system just described.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
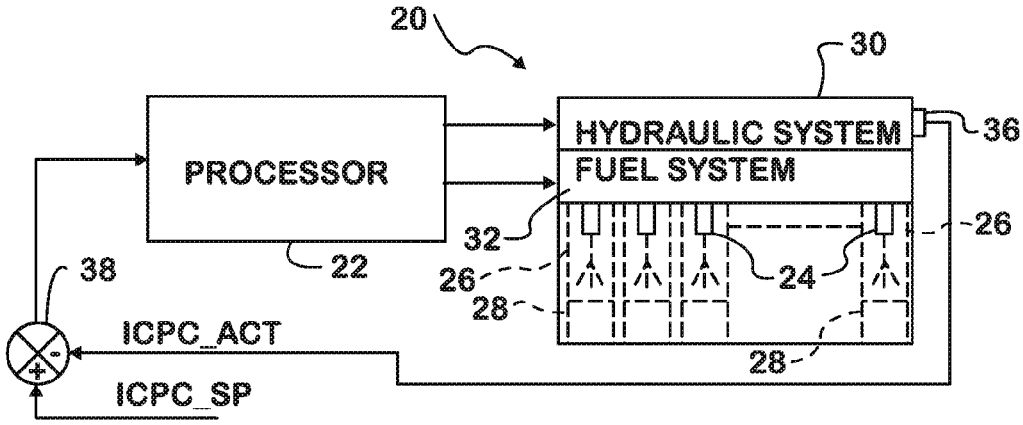
FIG. 1 is a general schematic diagram of a portion of an exemplary diesel engine relevant to an understanding of the invention.

FIG. 1 shows a schematic diagram of a portion of an exemplary diesel engine 20 relevant to an understanding of principles of the present invention. Engine 20 is used for powering a motor vehicle and comprises a control system that has a processor 22 for processing data from various sources to develop various control data for controlling various aspects of engine operation. The data processed by processor 22 may originate at external sources, such as sensors, and/or be generated internally.

Processor 22 acts through an injector driver module (not shown) for controlling the operation of HEUI fuel injectors 24. Each fuel injector 24 mounts on the engine in association with a respective engine combustion chamber illustrated by an engine cylinder 26 within which a piston 28 reciprocates. Each piston is coupled by a corresponding connecting rod to a crankshaft that provides engine output torque. Processor 22 can process data sufficiently fast to calculate, in real time, the timing and duration of fuel injector actuation to set both the timing and the amount of fueling.

Engine 20 further comprises a hydraulic (oil) system 30 having a pump for drawing oil from a sump and delivering the oil under pressure to an oil rail that serves in effect as a manifold for supplying oil, as a control fluid, to the individual fuel injectors 24. System 30 further comprises an injection pressure regulator (IPR) valve that is under the control of processor 22 via an IPR driver to regulate the hydraulic pressure of oil in the oil rail.

Each fuel injector 24 comprises a body that mounts on engine 20 in association with a respective cylinder 26 to enable a nozzle of the injector to deliver fuel into the respective cylinder where the injected fuel combusts with air that has entered via an air management system. The fuel injector body has an oil port connected to the oil rail of hydraulic system 30.

Figure 2:
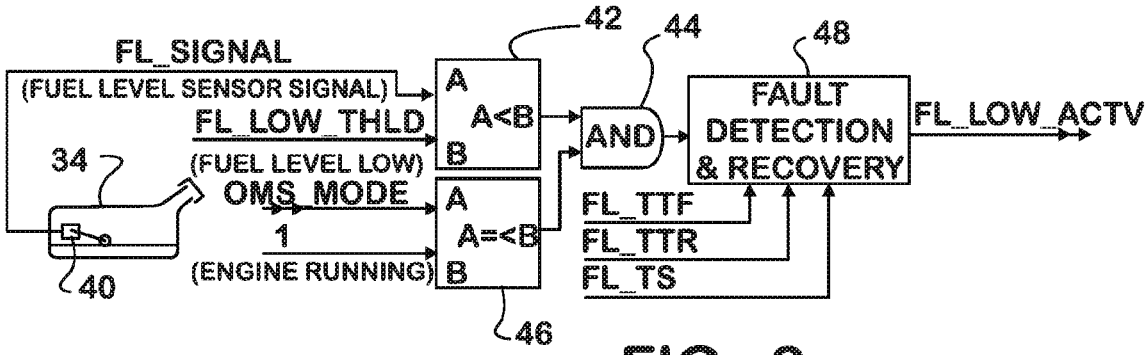
FIG. 2 is a first portion of a schematic software sub-strategy diagram of an exemplary embodiment of control strategy according to the present invention.

Engine 20 also has a fuel system 32 that comprises a fuel rail to which a fuel port of each injector 24 is communicated. A fuel tank 34 shown in FIG. 2 holds a supply of liquid fuel for use by engine 20. A transfer pump (not shown) draws fuel from tank 34 and delivers the fuel to a high-pressure pump in fuel system 32 that operates to keep a pressure head of liquid fuel in the fuel rail. Each fuel injector 24 also has an electrical connector that provides for the electrical connection of an actuator valve in the injector to the injector driver module.

The hydraulic pressure of the oil in the oil rail provides injector control pressure, or ICP, and it is that pressure that can be limited under certain circumstances in accordance with certain principles of the inventive strategy.

Figure 3:
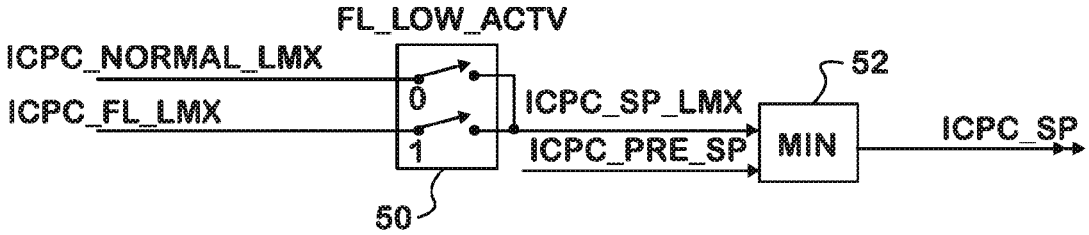
FIG. 3 is a second portion of the software sub-strategy diagram.

The basic ICP strategy shown in FIG. 1 operates to establish a desired set-point for ICP (ICPC_SP). Processor 22 develops a value for ICPC_SP in any suitably appropriate way for the particular engine. Because engine temperature, barometric pressure, engine speed, and engine fueling can influence ICP, the processing of engine temperature data, barometric pressure data, engine speed data, and desired engine fueling data according to any suitably appropriate algorithm or algorithms is one way of developing ICPC_SP. Compensation and filtering for certain transient conditions, offset compensation, and limiting of various data may be included as appropriate. The basic strategy imposes a maximum limit on ICP (ICPC_NORMAL_LMX), shown in FIG. 3.

Actual ICP in the oil rail is measured by a sensor 36 to provide a pressure measurement ICPC_ACT. An algebraic summing function 38 subtracts the value of ICPC_ACT from the value of ICPC_SP to create a value representing the difference between them. That difference is an error input to a closed-loop control strategy that seeks to continually null out the error when closed-loop control of ICP is active.

Each fuel injector 26 has a plunger that, during a fuel injection, is displaced within an internal pumping chamber by oil at ICP from the oil rail forcing fuel out of the pumping chamber. The timing and the stroke of the plunger are controlled by processor 22 opening and closing the actuator valve in the injector.

When the actuator valve opens, oil at ICP enters the injector to act on the plunger, which in turn acts on the fuel in the pumping chamber to amplify the pressure of fuel to a magnitude large enough to force a normally closed outlet valve at the injector's nozzle to open so that the amplified fuel pressure forces the fuel through the latter valve and out of the nozzle into the cylinder 26 as the plunger is being displaced by oil flowing into the fuel injector.

When the processor terminates the injection, the actuator valve closes, terminating ICP action on the plunger so that the outlet valve at the nozzle returns to normally closed condition. Oil in the injector is vented to the sump, and the pumping chamber refills with fuel, causing the plunger to retract and force oil out of the injector in the process.

A sensor 40 (FIG. 2) senses the quantity of fuel in tank 34. The value of a parameter FL_Signal represents that quantity. Various types of fuel sensors are known, and principles of the invention are typically not dependent on the use of any particular sensor. What is desired is that sensor 40 provide a sufficiently accurate measurement capable of reliably indicating when the quantity of fuel in tank 34 has dropped almost to an amount that could cause the entrance of the draw tube through which the transfer pump is drawing fuel out of the tank to cease being completely immersed in fuel as the vehicle is being driven over the road. Such a measurement will therefore take into account the effect of fuel slosh in the tank.

The value of a parameter FL_LOW_THLD represents a quantity of fuel that is preferably slightly larger than the quantity that could cause the entrance of the draw tube to cease being completely immersed in fuel as the vehicle is being driven over the road.

In accordance with the inventive strategy, the values of FL_Signal and FL_LOW_THLD are processed by a comparison function 42. As long as the value of FL_Signal is equal to or greater than the value of FL_LOW_THLD, the output of comparison function 42 is a logic "0". However, when the value of FL_Signal ceases to be equal to or greater than, i.e. becomes less than, the value of FL_LOW_THLD, the output of comparison function 42 becomes a logic "1".

The output of comparison function 42 is one input to an AND logic function 44. A second input to AND logic function 44 comes from the output of an evaluation function 46.

The purpose of evaluation function 46 is to signal that engine 20 is running. If the engine is running, the value of a parameter OMS_MODE is greater than or equal to "1". If the engine is not running, the value of parameter OMS_MODE is less than "1". Function 46 evaluates parameter OMS_MODE to deliver a "1" logic signal to AND function 44 when the engine is indicated to be running and to deliver a "0" logic signal when the engine is indicated not to be running.

Hence, AND function 44 outputs a "1" logic function only when the engine is running and the quantity of fuel in tank 34 is indicated to be less than a quantity of fuel that is slightly greater than the quantity that could cause the entrance of the draw tube to cease being completely immersed in fuel as the vehicle is being driven over the road.

A further portion 48 of the strategy is generically called Fault Detection & Recovery. In essence, its purpose is to maximize the probability that a change at the output of AND function 44 from a logic "0" to a logic "1" is indeed indicative of fuel running low in the tank by requiring that the logic "1" continue without interruption for a preset length of time FL_TTF, and similarly that a change back from a logic "1" to a logic "0" is indeed indicative of the quantity of fuel in the tank being great enough to assure that that the draw tube entrance will remain continuously immersed in fuel by requiring that the logic "0" continue without interruption for a preset length of time FL_TTR.

The parameter FL_TS controls the frequency at which portion 48 of the sub-strategy iterates. For example if the iteration rate is 20 times per second, and if FL_TTF is set to 40, then a change in the output of AND function 44 from "0" to "1" must remain unchanged for two seconds in order for the output FL_LOW_ACTV to change from "0" to "1". Any loss of continuity will stop the timing and immediately reset the timing to zero. Similarly, if FL_TTF is set to 40, then a change in the output of AND function 44 from "1" to "0" must remain unchanged for two seconds in order for the output FL_LOW_ACTV to change from "1" to "0". Any loss of continuity will stop the timing and immediately reset the timing to zero.

It is FL_LOW_ACTV that lowers the maximum limit for ICP when FL_LOW_ACTV has the value "1". Lowering the maximum limit is accomplished by a switch function 50 shown in FIG. 3.

When FL_LOW_ACTV has the value "0", the limit set by the basic ICP control strategy, ICPC_NORMAL_LMX, is passed by the switch function to become the value for a parameter ICPC_SP_LMX. The set point ICPC_SP is the smaller of the value for ICPC_SP_LMX and the value for a parameter ICPC_PRE_SP set by the basic strategy, as determined by a Minimum Selection function 52. In this way, function 52 sets the normal maximum limit for ICP.

However, when FL_LOW_ACTV has the value "1", a lower maximum limit ICPC_FL_LMX is passed by switch function 50 to become the value for ICPC_SP_LMX. The set point ICPC_SP continues to be the smaller of ICPC_SP_LMX and ICPC_PRE_SP. In this way function 52 sets a lower maximum limit for ICP when low fuel level is indicated by FL_LOW_ACTV.

Specific values for various parameters mentioned here are chosen on the basis of the specific fuel injectors used, the specific fuel tank geometry, and the specific sensor. It should be intuitively obvious that fuel slosh in an essentially full fuel tank will not affect the continuous immersion of the entrance of the draw tube in the fuel, but that as the engine runs and depletes the amount of fuel in the tank, a point will eventually be reached where the possibility exists that continuous immersion of the draw tube entrance in the liquid fuel may be lost. That specific point may be difficult to determine with precision, and so if it may be preferable to assign a value for FL_LOW_THLD that provides a small margin of safety for assuring that the maximum ICP limit is lowered earlier rather than later as the quantity of fuel in the tank becomes low.

While a presently preferred embodiment of the invention has been illustrated and described, it should be appreciated that principles of the invention apply to all embodiments falling within the scope of the following claims.

What is claimed is:

1. An internal combustion engine comprising:

a control system;

a fuel system that draws liquid fuel from a fuel tank to charge fuel injectors that when actuated by the control system force fuel charges into engine combustion chambers using hydraulic fluid at injection control pressure (ICP); and the control system comprising a processor for executing an ICP control strategy, wherein the strategy comprises processing a first fuel value indicative of the quantity of fuel presently in the tank and a second fuel value representing a quantity of fuel in the tank at which a maximum ICP limit set by the ICP control strategy should be changed, and when the result of the processing discloses that the second fuel value is less than the first fuel value, execution of the ICP control strategy reduces the maximum ICP limit from a greater value to a lesser value.

2. An engine as set forth in claim 1 wherein execution of the ICP control strategy conditions reduction of the maximum ICP limit from the greater value to the lesser value on the second fuel value being continuously less than the first fuel value for a defined length of time.

3. An engine as set forth in claim 1 wherein execution of the ICP control strategy restores the maximum ICP limit from the lesser value to the greater value when the result of the processing discloses that the second fuel value ceases to be less than the first fuel value.

4. An engine as set forth in claim 3 wherein execution of the ICP control strategy conditions restoration of the maximum ICP limit from the lesser value to the greater value on the second fuel value continuously ceasing to be less than the first fuel value for a defined length of time.

5. An engine as set forth in claim 1 comprising a switch function having inputs whose values correspond respectively to the greater and the lesser values of the maximum ICP limit, and wherein the switch function is controlled by the result of processing the first and second fuel values.

6. A fuel system and a control system for an internal combustion engine:

wherein the fuel system draws liquid fuel from a fuel tank to charge fuel injectors that when actuated by the control system force fuel charges into engine combustion chambers using hydraulic fluid at injection control pressure (ICP); and wherein the control system comprises a processor for executing an ICP control strategy that comprises processing a first fuel value indicative of the quantity of fuel presently in the tank and a second fuel value representing a quantity of fuel in the tank at which a maximum ICP limit set by the ICP control strategy should be changed, and when the result of the processing discloses that the second fuel value is less than the first fuel value, causing the maximum ICP limit to be reduced from a greater value to a lesser value.

7. A fuel system and a control system as set forth in claim 6 wherein execution of the ICP control strategy conditions reduction of the maximum ICP limit from the greater value to the lesser value on the second fuel value being continuously less than the first fuel value for a defined length of time.

8. A fuel system and a control system as set forth in claim 6 wherein execution of the ICP control strategy restores the maximum ICP limit from the lesser value to the greater value when the result of the processing discloses that the second fuel value ceases to be less than the first fuel value.

9. A fuel system and a control system as set forth in claim 8 wherein execution of the ICP control strategy conditions restoration of the maximum ICP limit from the lesser value to the greater value on the second fuel value continuously ceasing to be less than the first fuel value for a defined length of time.

10. A fuel system and a control system as set forth in claim 6 comprising a switch function having inputs whose values correspond respectively to the greater and the lesser values of the maximum ICP limit, and wherein the switch function is controlled by the result of processing the first and second fuel values.

11. A method for control of injection control pressure (ICP) that is used to force the injection of fuel into an engine combustion chamber comprising:

processing a first fuel value indicative of the quantity of fuel presently in a fuel tank and a second fuel value representing a quantity of fuel in the tank at which a maximum ICP limit should be changed, and when the result of the processing discloses that the second fuel value is less than the first fuel value, causing the maximum ICP limit to be reduced from a greater value to a lesser value.

12. A method as set forth in claim 11 comprising conditioning reduction of the maximum ICP limit from the greater value to the lesser value on the second fuel value being continuously less than the first fuel value for a defined length of time.

13. A method as set forth in claim 11 comprising restoring the maximum ICP limit from the lesser value to the greater value when the result of the processing discloses that the second fuel value ceases to be less than the first fuel value.

14. A method as set forth in claim 13 comprising conditioning restoration of the maximum ICP limit from the lesser value to the greater value on the second fuel value continuously ceasing to be less than the first fuel value for a defined length of time.

15. A method as set forth in claim 11 comprising controlling a switch function by the result of processing the first and second fuel values to cause the switch function to pass one of the greater and the lesser values of the maximum ICP limit to the exclusion of the other based on the result of processing the first and second fuel values.

* * * * *